United States Patent [19]

Lipukhin et al.

[11] Patent Number: 4,920,705

[45] Date of Patent: May 1, 1990

[54] METHOD OF ABRASIVE POWDER DESCALING OF A STRIP

[76] Inventors: Jury V. Lipukhin, ploschad Metallurgov, 5, kv.I5.; Eduard A. Garber, ulitsa M. Gorkogo, 85, kv.I7., both of Vologodskaya oblast, Cherepovets; Boris Y. Orlov, ulitsa Krasnykh Partizan, 3, kv.4.; Viktor N. Ponosov, ulitsa Pobedy, 24, kv.II5., both of Sverdlovsk; Vladimir M. Novikov, prospekt Lunacharskogo, 48, kv.I57., Vologodskaya oblast, Cherepovets; Gennady N. Rumako, deceased, late of prospekt Ordzhonikidze, II, kv.9., Sverdlovsk, all of U.S.S.R., by Tamara A. Rumako, Administrator

[21] Appl. No.: 294,066

[22] PCT Filed: Mar. 2, 1988

[86] PCT No.: PCT/SU88/00049

§ 371 Date: Nov. 2, 1988

§ 102(e) Date: Nov. 2, 1988

[87] PCT Pub. No.: WO88/06497

PCT Pub. Date: Sep. 7, 1988

[30] Foreign Application Priority Data

Mar. 3, 1987 [SU] U.S.S.R. ..... 4199247

[51] Int. Cl.[5] ..... B24B 1/00

[52] U.S. Cl. ..... 51/318; 51/7; 51/18; 51/326; 51/165.71; 51/165.72

[58] Field of Search ..... 51/DIG. 10, 317, 7, 51/17, 21, 18, 326, 165.9, 165.71–165.72; 226/44, 117, 119

[56] References Cited

U.S. PATENT DOCUMENTS

| | | | |
|---|---|---|---|
| 801,403 | 10/1905 | Rupley | 51/DIG. 10 |
| 2,335,196 | 11/1943 | Pecsok | 51/DIG. 10 |
| 2,419,448 | 4/1947 | Gordon | 51/18 |

FOREIGN PATENT DOCUMENTS

| | | | |
|---|---|---|---|
| 887048 | 12/1981 | U.S.S.R. . | |
| 954131 | 8/1982 | U.S.S.R. . | |
| 1030056 | 7/1983 | U.S.S.R. . | |
| 0971874 | 10/1964 | United Kingdom | 226/44 |
| 2173722 | 10/1986 | United Kingdom . | |

OTHER PUBLICATIONS

Chermetinformatsia, 10–1986, No., pp. 42–45.

*Primary Examiner*—Robert Rose
*Attorney, Agent, or Firm*—Lilling & Greenspan

[57] ABSTRACT

The method envisages measuring strip tension and computing the difference between tensions at the inlet to and outlet from each descaling zone, comparing this difference is strip tension with a preset difference, and compensating for deviations in strip tension from the preset difference by varying the pressure exerted by the powder on the strip in each descaling zone.

3 Claims, 1 Drawing Sheet

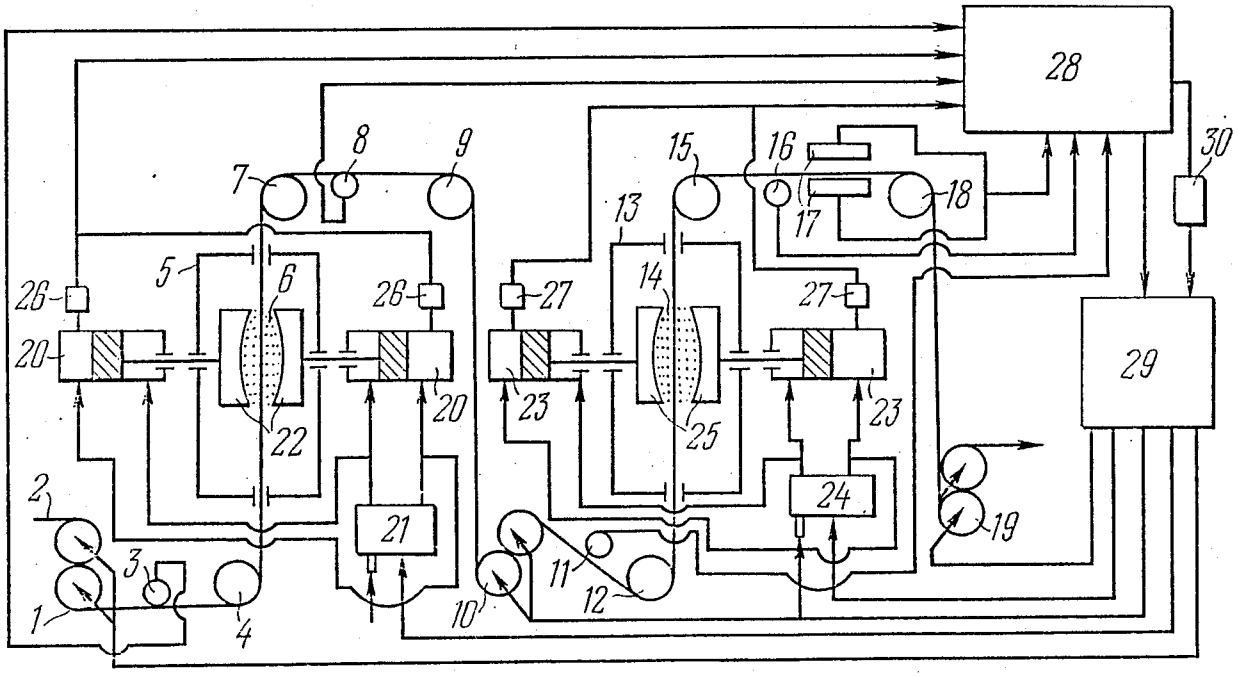
30
28
29
18
19
16
17
27
23
24
15
25
14
13
12
11
10
9
20
28
21
8
6
22
7
4
5
3
2
1
28
20

METHOD OF ABRASIVE POWDER DESCALING OF A STRIP

BACKGROUND OF THE INVENTION

1. Field of the Invention

This invention relates to rolling, and more particularly to descaling a strip by abrasive powder.

2. Description of the Prior Art

There is known a method of abrasive powder descaling of a strip (SU, A, 954,131) in which the strip is first treated with the abrasive powder by applying to the powder and maintaining of a pressure between 4 and 6 MPa, the strip being pulled through by applying thereto a tension force. The strip is then pickled. However, ecological hazard makes the method less promising.

A method bearing the closest resemblance to one to be hereinafter described resides in that the strip is pulled at a tension through at least two successive descaling zones where scale is removed by applying to the strip a pressure of abrasive powder varying within a range preset for each descaling zone (Bulletin "Chermetinformatsia", 1987, No. 6, pp. 42 to 45). This prototype method is characterized by the following disadvantages. Firstly, monitoring the strip tension, depending largely on the resistance to pulling the strip through the descaling zone occupied by the abrasive powder, is not envisaged. This makes the strip more susceptible to breaking due to high tension forces necessary for overcoming the resistance on the part of the abrasive powder pressed to the strip. Each strip breaking causes loss of metal, unscheduled stops for discharging the powder, threading and welding together strip ends, and recharging the powder. In addition, a sudden increase in strip tension at the inlet to the descalling zone arising in response to a sudden drop in the pressure of powder on the strip makes it imperative to operatively change operation of the strip tension unit acting to pull the strip through the preceding descaling zone. Unfortunately, this is impossible in the absence of facilities for controlling the strip tension at the inlet to the descaling zone.

The known method also fails to control the force of pressure applied by the powder to the strip and the tension of the strip to attain the final aim of the process, viz., thorough cleaning of the strip from scale, which leads to high power consumption as it is impossible to preset a minimum powder pressure necessary for removing scale from each specific strip.

It is not advisable, when using this prior art method, to increase the pressure of powder on the strip to above the maximum working pressure, since such an increase fails to reduce the quantity of residual scale at the strip surface, and makes the strip surface scratched. For example, in the first descaling zone the working pressure rage of powder applied to the strip is 1.5–2.0 MPa. However, for a given strip (taking into account the natural spread in the physical and mechanical properties of strips even within one run) the maximum allowable pressure can be 1.8 or 1.9 MPa, rather than 2.0 MPa. Therewith, the quantity of residual scale at the strip surface is minimal at this pressure (such as 30% of the initial scale present at the strip surface), whereas an increase in this pressure to 2.0 MPa leads to strip surface defects and unjustified power consumption rather than to a reduction in the quantity of residual scale at the strip surface.

The aforedescribed makes the prior art method disadvantageous for controlling an advanced and highly efficient apparatus for descaling strips by abrasive powder, preventing strips from breaking, and attaining thorough scale removal from strips.

SUMMARY OF THE INVENTION

The present invention aims at providing a method of abrasive powder descaling of a strip in which purpose-oriented measuring and stabilizing the tension of the strip, as well as controlling the pressure of powder on the strip in descaling zones, would ensure a higher quality of descaling and prevent the strip from breaking.

The aims of the invention are attained in a method of abrasive powder descaling of a strip which envisages pulling the strip at a tension through at least two successive descaling zones where the strip is cleaned by forcing the abrasive powder thereto at a pressure varied, depending on the material of the strip and type of scale, within a preset range for each descaling zone. According to the invention, the tension of the strip is measured at the inlet to and outlet from each descaling zone, the difference between these tension forces is computed and compared with a preset difference in the tension forces, and deviation of the measured difference of the tension forces from the preset tension force is compensated by changing the pressure exerted by the powder on the strip in each descaling zone.

Measuring the strip tension at the outlet from each descaling zone allows control of this major parameter of the descaling procedure and thereby limit the strip tension forces, whereby strip breaking is prevented.

Monitoring the tension of the strip at the inlet to each descaling zone allows, firstly, to control the difference in strip tension at the outlet from and inlet to each descaling zone aimed at evaluating the stability of pressure exerted by the powder on the strip influencing the quality of descaling. Secondly, monitoring the strip tension at the inlet to the descaling zone is essential for controlling the strip tension before this zone and for pulling the strip through the preceding descaling zone.

Computing the difference in strip tension at the inlet to and outlet from each descaling zone and comparing it with the preset difference make it possible to determine preset strip tension differences for each descaling zone which ensure the minimum of residual scale at the strip leaving the last descaling zone, and to automatically maintain the difference in the measured tensions equal or close to the preset strip tension. Otherwise, it would be necessary to monitor the quantity of residual scale at the strip surface not only at the outlet from the last descaling zone, but also in the spaces between the descaling zones, which would complicate the control system and result in a higher equipment and operating costs.

Preferably, for determining the preset difference in the tension force in each descaling zone, the minimum pressure of powder on the strip is established within a preset range for each descaling zone, the quantity of residual scale at the strip at the outlet from the last descaling zone is measured, the pressure of powder on the strip is successively increased in each descaling zone beginning from the first descaling zone to a magnitude of such a pressure ensuring the minimum quantity of residual scale at the strip, and the difference between the strip tensions corresponding to this force of pressure exerted by the powder on the strip is assumed as the preset difference.

Successive execution of the above procedures ensures minimized power expenditures proportional to the pressure of powder exerted on the strip. Concurrently, this affords, by gradually increasing the pressure of powder on the strip in each descaling zone, to finally provide a pressure at which the quantity of scale at the strip is minimized, whereas the differences in the measured strip tensions in each descaling zone are memorized and assumed as the preset strip tension differences.

Due to a combination of controlling the quantity of residual scale at the strip and other techniques, it is possible to preset exactly the pressure within a range of pressures for the powder to exert on the strip in each zone which would provide the most advantageous descaling effect while not necessarily being the highest in this range. The pressure of powder on the strip is increased not simultaneously in all the chambers. The preferred procedure rather starts from increasing the pressure in the first descaling zone as the most important, since the hardest scale layer or hematite is removed in this zone, after which scale removal in the successive zones is greately facilitated. Therefore, without establishing the optimum pressure of powder on the strip in the first descaling zone it is disadvantageous to raise the pressure in the second and third zones.

Assuming the difference between the strip tensions at the inlet to and outlet from each descaling zone ensuring the minimum of residual scale at the outlet from the last descaling zone as the preset difference allows to limit the equipment measuring the residual scale by one set at the outlet from the last descaling zone.

Compensation for deviations from the difference between the measured strip tension and the preset strip tension by varying the pressure of powder on the strip makes it possible to stabilize descaling conditions in each descaling zone with minimum consumption of power. This advantage is accounted for by that the difference in the strip tensions equals to the force of resistance thereof in the course of pulling the strip through the layer of abrasive powder compressed to the strip.

The higher is the pressure of powder exerted on the strip, the greater is the difference in the strip tensions. In consequence, by varying the force of pressure exerted by the powder on the strip it is possible to control the difference in strip tension. At the same time, the use of only the powder compression force rather than the difference in strip tension would complicate the equipment facilities for controlling the operation of the descaling unit. The reason is that the direct control over the pressure of powder on the strip by providing a corresponding pick-up inside the powder-filled descaling zone is difficult due to heavy-duty operating conditions for such a pick-up.

The use of differences in strip tension obviates this disadvantage.

Preferably, as the tension of the strip at the outlet from any descaling zone increases to a magnitude of 60–65% of the yield strength of the material of the strip, the pressure of powder on the strip in this descaling zone is reduced until the strip tension is below this magnitude.

These procedures make it possible to avoid strip breaking due to the fact that tensile stresses therein caused by the force of tension reach the ultimate strength of the strip material to make the strip less susceptible to cold working due to plastic elongation. In fact, the yield strength of steel strips can vary relative to the rated value within ±25–30% depending on rolling technology employed at specific production facilities.

In consequence, an increase in the tensile stresses to below 60% of the yield strength of the strip material causes no breaking of the strip, whereas an increase in the tensile stresses to exactly 60% of the yield strength brings such stresses to a point short of only 10% of the critical level. A tensile stress level of over 60% increases the likelihood that a further growth results in a critical level fraught with strip breaking. Taking into account delays in response of the control equipment, it is therefore necessary to take actions leading to reducing strip tension by bringing down the pressure exerted by the powder on the strip. Upon attaining a tension level of 65% the yield strength of the strip material the situation threatens with strip breaking, as the tension margin equals a mere 5% and therefore while decreasing the pressure of powder on the strip it is necessary to reduce strip tension to a safe level of less than 60% the yield strength of the strip material. This in turn makes the descaling unit more reliable in operation. An increase in the pressure of powder on the strip in the successive descaling zone in cases, when the pressure of powder on the strip in the preceding zone was reduced, and after bringing the tension of the strip to a safe level with an accompanying growth in the quantity of residual scale on the strip, allows to attain a higher strip descaling quality, since weakening the action of the powder on the strip in the preceding zone is compensated by a more vigorous action of the powder on the strip in the suceeding zone.

BRIEF DESCRIPTION OF THE DRAWINGS

The invention will now be described in greater detail with reference to a specific embodiment thereof taken in conjunction with the accompanying FIGURE of the drawings showing the principle diagram of a unit for carrying out the proposed method of descaling a strip by abrasive powder.

DESCRIPTION OF THE PREFERRED EMBODIMENT

The proposed method of cleaning a strip from scale envisages the following operations.

A strip to be cleaned of scale is pulled at the front end with a certain tension force through several (not less than two) successive zones of abrasive powder. At the outlet from the last successive zone the quantity of remaining scale is measured. Simultaneously, tension of the strip at the inlet to each descaling zone and at the outlet therefrom, and then the difference between the strip tensions at the inlet to and outlet from each descaling zone is calculated. After this the abrasive powder is forced to the strip in each descaling zone at a minimum pressure within the range of pressures preset for each descaling zone. In this manner, in each descaling zone the strip is cleaned of scale by applying the action of abrasive powder to the strip surface. At the same time the following parameters are continuously measured: the quantity of residual scale at the strip surface at the outlet from the last descaling zone, tension of the strip at the inlet to and outlet from each descaling zone, and pressure force exerted by the powder on the strip. Calculations are then made on the basis of these measurements at preset time intervals (such as every second) of a difference in the tension of the strip at the inlet to and outlet from each descaling zone, a difference between the last and preceding results of measurements of the quantity of the residual scale at the strip, a difference between the allowable (preset conditions for breaking strength) magnitude of tension of the strip and the measured magnitude of strip tension at the outlet from each descaling zone. Then the pressure exerted by the powder on the strip in the first descaling zone is progressively stepwise increased. The quantity of residual scale at the strip, as measured after presetting a successive increase in the pressure force exerted by the powder on the strip in the first descaling zone, is compared with the quantity of residual scale measured after presetting the preceding magnitude of pressure exerted by the powder on the strip in the first descaling zone. If the result of the last measurement is smaller than the result of the preceding measurement, then the pressure of powder exerted on the strip in the first descaling zone is increased. If the result of the last measurement of the quantity of residual scale is equal to or greater than the result of the preceding measurement, then a pressure of powder equal to that during the preceding measurement of the quantity of residual scale is preset in the first descaling zone. After this the difference between the measured tensions of the strip at the inlet to the first descaling zone and outlet therefrom is memorized as the preset difference of tensions for the first descaling zone, whereupon the difference in the measured tensions is compared with the preset tension difference. If deviation from the difference between the measured tensions and the difference between the preset tensions exceeds the established level (which depends on the sensitivity of the tension pickups), then the pressure of the powder exerted on the strip in the first descaling zone is changed until this deviation is reduced to below the above level. For example, if the difference in the measured tensions is greater than the preset one, the pressure of powder exerted on the strip is reduced, or, if it is smaller, the pressure of powder is increased.

After determining the preset difference in tensions for the first descaling zone the pressure of powder exerted on the strip in the second descaling zone is stepwise increased, and with respect to this second descaling zone all operations associated with the first descaling zone are repeated, thereby presetting in the second descaling zone the required difference in the tension of the strip and compensating for deviations from this difference by varying the pressure of powder exerted on the strip.

In the presence of a third descaling zone all the procedures are repeated in the same sequence as for the second descaling zone.

After determining the quantity of residual scale at the outlet from the last descaling zone the minimum pressures of powder on the strip are preset in all the descaling zones to ensure the highest descaling efficiency, i.e. the minimum of residual scale at the strip leaving the apparatus.

If during taking measurements of the strip tension at the outlet, for example, from the first descaling zone this tension turns out to be critical, the pressure of powder on the strip in this zone is reduced until the tension of the strip is reduced to below the critical point. If the thus measured quantity of residual powder on the strip grows, then the pressure of powder on the strip is increased in the successive (for example, in the second) descaling zone until the quantity of residual scale in minimized. After this new magnitudes of preset differences in the tension of the strip will be determined for the first and second descaling zones. Thereby, the danger of strip breaking will be avoided without affecting the quality of descaling.

The proposed method of abrasive powder descaling of a strip is embodied in an apparatus represented in the FIGURE of the accompanying drawings which comprises a strip tension station 1 through which the strip 2 with a scale coat passes from the head portion (not shown) of the apparatus, a roller 3 of a unit for measuring the inlet tension of the strip, a by-pass roller 4, a first chamber 5 filled with abrasive powder 6 having a particle size 400–600 mkm, a by-pass roller 7, a roller 8 of the unit for measuring the strip tension at the outlet from the first chamber 5, a by-pass roller 9, a strip tension station 10 pulling the strip 2 through the first descaling chamber 5, a roller 11 of the unit for measuring strip tension at the outlet from the first chamber 5, a by-pass roller 12, a second chamber 13 filled with abrasive powder 14 having a particle size 200–400 mkm, a by-pass roller 15, a roller 16 for measuring strip tension at the outlet from the second chamber 13, an optical sensor 17 for controlling the quantity of residual scale at the strip 2, a by-pass roller 18, and a strip tension station 19 for pulling the strip 2 through the second chamber 13. The chamber 5 includes hydraulic cylinders 20 for providing a pressure force of the powder 6 to the strip 2 within a range 1.5 to 2.0 MPa by virtue of the pressure of oil conveyed from a control valve distributor 21. The hydraulic cylinders 20 are connected through their rods to vanes 22 of the mechanism for compacting the powder 6, the interior of the vanes 22 accommodating electromagnets (not shown) for a magnetic field to act on the powder present between the vanes 22. The chamber 13 includes hydraulic cylinders 23 providing a pressure force of the powder 14 to the strip 2 in the range 1.0 to 1.5 MPa thanks to the pressure of oil conveyed from a control valve distributor 24 by vanes 25 accommodating electromagnets (not shown) for the magnetic field to act on the powder 14 between the vanes 25. Pressure cavities of the hydraulic cylinders 20 and 23 have pressure pick-ups 26 and 27 scaled in the units of the force of compression of the powders 6 and 14 exerted on the strip 2. The rollers 3, 8, 11 and 16 of the strip tension measurement units, optical sensor 17 of the quantity of residual scale, and pressure pick-ups 26 and 27 are electrically connected to a measuring and computing block 28, which in turn is connected to a control unit 29. The control unit 29 is connected through electric circuits with drives of the strip tension stations 1, 10, 19 and with the control valve distributors 21, 24. A presetter unit 30 serves for presetting the initial working parameters (pressure exerted by the powder on the strip, strip tension, etc.), this unit 30 being connected via electric circuits with the blocks 28 and 29 and provided at the control panel of the apparatus.

The apparatus shown in the accompanying Figure of the drawings employing the proposed method operates in the following manner.

The strip 2 is threaded into the apparatus by passing it through the chambers 5 and 13 in the absence of powder therein, the strip tension stations 1, 10, 19 being controlled manually at a speed sufficiently slow for strip threading. The powder 6 is then charged to the chamber 5 and powder 14 to the chamber 13, the presetting unit 30 is caused to feed to the measuring and computing unit 28 and to the control unit 29 the initial parameters (type of steel, thickness and width of the strip), preset range of pressures of powder on the strip (for chamber 5 $q_{min}=1.5$ MPa, $q_{max}=2.0$ MPa; for chamber 13 $q_{min}=1.0$ MPa, $q_{max}=1.5$ MPa), and the units 28 and 29 are brought to operation by the pick-ups 3, 8, 11, 16, 17, 26, 17. The circuit is then switched to automatic functioning, after which signals are conveyed from the control unit 29 for the control valves 21 and 24 to set the minimum pressures in the pressure cavities of the cylinders 20 and 23 (in the cylinders 20 corresponging to $q_{min}=1.5$ MPa, and in cylinders 23 to $q_{min}=1.0$ MPa), the strip tension stations 1, 10, 19 start to pull the strip 2 through the apparatus at a working speed, and the process of strip descaling proceeds.

The strip tension pick-ups 3, 8, 11, 16 transmit strip tension signals at the inlet to and outlet from the chambers 5 and 13 to the measuring and computing unit 28 to compute differences Δ in tension:

in the chamber 5: $\Delta T_5=T_8-T_3$;

in the chamber 13: $\Delta T_{13}=T_{16}-T_{11}$;

($T_3$, $T_8$, $T_{11}$, $T_{16}$—are tension magnitudes as measured by the rollers 3, 8, 11, 16, respectively). At the same time, the pick-up 17 conveys signals on the quantity of residual scale at the strip 2 to the unit 28. If this quantity is not zero, then upon a signal from the unit 29 the distributor 21 acts to increase the pressure in the cylinders 20 at a step of, for example, 0.1 MPa, thereby accordingly increasing the pressure exerted by the powder 6 on the strip 1 in the chamber 5. With each new magnitude of pressure exerted by the powder on the strip the unit 28 acts to compare the current quantity of residual scale at the strip 2 with the previous quantity according to the readings of the pick-up 17. Let us assume that at a pressure of powder q=1.8 MPa the quantity K of residual scale is 30%, and at q=1.9 MPa K=30%. Then the pressure of powder 6 exerted on the strip 2 in the chamber 5 is set at $q_{opt}=1.8$ MPa, and the difference in the strip tension $T_{5opt}$ corresponding to this pressure is memorized in the unit 28 and conveyed to the unit 29 as the preset difference in the strip tension for the chamber 5. The unit 29 acts on the drives of the tension stations 1 and 10, compares this difference with the difference in the measured strip tension, and maintains the difference in the measured strip tension equal or close to the preset difference. Then, upon a command from the unit 29 the distributor 24 acts to stepwise increase the pressure in the cylinders 23 accordingly increasing the pressure of powder 14 on the strip 1 in the chamber 13. In a similar manner, the quantity of residual scale at the strip 1 is determined with each new value of the pressure of powder in the chamber 13. Assuming, for example, that K=0 at a pressure of powder 14 on the strip 1 in the chamber 13 equal to $q_{13opt}=1.2$ MPa. Then the difference $\Delta T_{13opt}$ in strip tensions corresponding to this pressure is memorized by the unit 28 to be conveyed as the preset tension difference for the chamber 13 to the unit 29 which acts on the drives of the strip tension stations 10 and 19 to maintain this difference. Therefore, the process of complete removal of scale proceeds with minimized power expenditures for a given strip type.

Let us assume that at some point in time the strip tension difference $\Delta T_5$ reduces to become less than $\Delta T_{5opt}$ testifying to a reduction in the pressure of powder 6 on the strip 2 in the chamber 5, for example, due to leaks of the powder 6 from under the vanes 22. In this case, automatically upon a command from the unit 29 the pressure in the cylinders 20 will grow until the pressure of powder 6 on the strip 2 resumes the magnitude $\Delta T_5=\Delta T_{5opt}$.

Supposing at some point in time the pick-up 17 registered a growth in the quantity K of residual scale, such as when K=10%, which indicates that a portion of the strip having a higher scale strength and greater adhesion thereof to the strip surface passes through the apparatus. In this case the pressure of powder 6 on the strip in the chamber 5 is caused, on a signal from the unit 29, to grow to result in an increase in the strip tension $T_8$ and in the strip tension difference $\Delta T_5$. The measuring and computing unit 28 continuously computes the tensile stress $\sigma$ in the strip at the outlet from the chamber 5:

$$\sigma_5 = \frac{T_8}{b\,h}, \tag{1}$$

where b and h are the width and thickness of the strip. In addition, the unit 28 executes the following comparison:

$$\sigma_5 < 0.6\,\sigma_s, \tag{2}$$

where $\sigma_s$ is the rated yield strength of the strip for a given type of steel. If the inequality (2) is not conformed with, the pressure of powder 6 on the strip 2 is automatically reduced until the inequality (2) is not adhered to. Leaving the magnitude $q_5$ at the maximum allowable level, the unit 29 sends a signal to the distributor 24 to increase pressure in the cylinders 23 which in turn produce a higher pressure of powder 14 on the strip 2 in the chamber 13 thereby reducing the magnitude of K.

In view of the aforedescribed, the use of the proposed method ensures carrying out continuous descaling without strip breaking at minimized consumption of power with high quality of descaling and minimum of operating costs. As compared to the prototype, this allows to attain a 1.5 times higher production capacity, reduce consumption of power by 20–30%, and reduce reject at least by a factor of two.

The invention can be used with success for descaling hot-rolled wide strips of low-carbon and high-carbon, stainless, tool and other special types of steel.

We claim:

1. A method of abrasive powder descaling of a strip comprising the steps of pulling the strip at a tension through at least two successive descaling zones having an inlet and an outlet where the strip is cleaned by forcing the abrasive powder thereto at a pressure varied, depending on the material of the strip and the type of scale, within a preset range for each descaling zone; measuring tension of the strip at the inlet to and outlet from each descaling zone; computing the difference between these tension forces; and comparing with a preset difference in the tension forces, and deviation in the measured difference of the tension forces from the preset tension force being compensated by changing the pressure exerted by the powder in each descaling zone.

2. A method as claimed in claim 1, wherein determining a preset difference in the tension force in each descaling zone a minimum pressure of powder on the strip is established within the preset range for each descaling zone, the quantity of residual scale at the strip at the outlet thereof from the last descaling zone is measured, the pressure of powder exerted on the strip is successively increased in each descaling zone beginning from the first descaling zone to a magnitude of such a pressure ensuring the minimum quantity of residual scale on the strip, and the difference between the strip tensions corresponding to this force of pressure exerted by the powder on the strip is assumed as the preset difference.

3. A method as claimed in claim 1, wherein an increase in the tension of the strip at the outlet from any descaling zone to a magnitude 60–65% of the yield strength of the material of the strip the pressure of powder on the strip in this descaling zone is reduced until a strip tension is less than this magnitude.

* * * * *